United States Patent [19]

Taylor

[11] 3,937,604

[45] Feb. 10, 1976

[54] GEAR PUMP OR MOTOR WITH AXIALLY MOVABLE BEARING BLOCKS

[75] Inventor: John Sassons Taylor, Solihull, England

[73] Assignee: Joseph Lucas (Industries) Limited, Birmingham, England

[22] Filed: Aug. 19, 1974

[21] Appl. No.: 498,841

Related U.S. Application Data

[63] Continuation of Ser. No. 348,630, April 6, 1972, abandoned.

[30] Foreign Application Priority Data

Apr. 15, 1972 United Kingdom ..... 17491/72

[52] U.S. Cl. ..... 418/132; 418/135

[51] Int. Cl.[2]...F01C 19/08; F03C 3/00; F04C 15/00

[58] Field of Search ..... 418/131, 132, 135

[56] References Cited

UNITED STATES PATENTS

| | | | |
|---|---|---|---|
| 2,691,945 | 10/1954 | Wichorek | 418/132 |
| 3,104,616 | 9/1963 | Peet | 418/132 |
| 3,294,028 | 12/1966 | Dahl | 418/132 |
| 3,539,282 | 11/1970 | Forschner | 418/132 |
| 3,582,242 | 6/1971 | Hansen | 418/132 |

*Primary Examiner*—John J. Vrablik
*Attorney, Agent, or Firm*—Holman & Stern

[57] ABSTRACT

A rotary hydraulic pump or motor has a pair of ports and a pair of meshed toothed gear elements each of which is journalled in a pair of bearing blocks. One block in each pair is fixed within a housing and the other block in each pair is slidable in the housing so that the axial faces of the gear teeth can be engaged by the axial end faces of associated blocks. The fluid pressure at the high pressure port is applied to the end faces of the sliding blocks remote from the gear elements, so that the sliding blocks are urged towards the fixed blocks.

4 Claims, 3 Drawing Figures

GEAR PUMP OR MOTOR WITH AXIALLY MOVABLE BEARING BLOCKS

BACKGROUND OF THE INVENTION

This is a continuation, of application Ser. No. 348,630, filed Apr. 6, 1972 now abandoned.

This invention relates to rotary hydraulic machines of the kind in which fluid displacement accompanies rotation of meshed gear elements.

SUMMARY OF THE INVENTION

According to the invention a gear pump or motor comprises a housing having an inlet port and an outlet port, two pairs of part cylindrical bearing blocks in the housing, meshed gear elements journalled in the respective pairs of bearing blocks so that axially-directed faces of the gear elements are engageable with adjacent faces of the bearing blocks, with one bearing block in each pair being axially movable in the housing, means for limiting the movement of the other bearing block in the pairs in response to pressure on said axial end faces of said movable bearing blocks, said blocks having recesses lying adjacent the respective zones at which the inlet and outlet ports open to the inside of the housing, and further recesses in the cylindrical surfaces of the blocks which, in conjunction with the housing, define passages extending around the cylindrical surfaces of the blocks to locations adjacent the inlet port and thence axially of the blocks to the remote axial end face.

In a preferred embodiment of the invention, said axial end faces have areas whose effective centers are spaced from the axes of rotation of the associated gear elements such that pressures on said end faces oppose forces applied, in use, to said movable bearing blocks by a pressure at said outlet port.

In a further preferred embodiment, said passages communicate with axially extending surfaces of said movable bearing blocks at locations thereon remote from said outlet port.

An example of a machine according to the invention is shown in the accompanying drawings, in which:

DETAILED DESCRIPTION OF THE INVENTION

Figure 1:
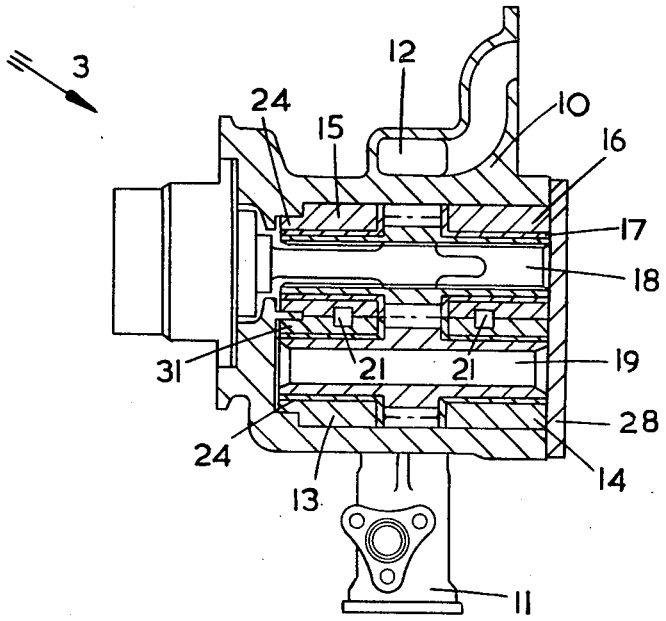
FIG. 1 is a longitudinal section through a gear pump.

A gear pump includes a housing 10 having an inlet port 11 and an outlet port 12. Pairs of part cylindrical bearing blocks 13, 14 and 15, 16 are mounted in the housing 10 and include antifriction portions indicated at 17. Two gear elements 18, 19 are journalled in the respective pairs of blocks so that the axial end faces of the toothed portions of the gear elements engage adjacent end faces of the bearing blocks.

The blocks 13, 14, 15, 16 are generally cylindrical, but are provided with flat surfaces 20. The surfaces 20 on blocks 13, 15 are in contact, as are surfaces 20 on blocks 14, 16, thereby preventing rotation of the blocks relative to each other and to the housing 10. The blocks 13, 15 and blocks 14, 16 are respectively mutually located by means of dowels 21, whereby the blocks 13, 15 move axially in unison, as do the blocks 14, 16.

The blocks 13, 14, 15, 16 are formed with cut-away portions 22, 23 which lie adjacent the respective zones at which the pump inlet port and outlet port open on to the inside of the housing 10. The blocks 13, 15 have axially extending spigots 24 whose axes are spaced from the axes of the associated gear elements 18, 19 so as to define on the blocks 13, 15, end faces 25, 26 whose centers are offset from the axes of rotation of the gear elements. The effective centers of pressure of the faces 25, 26 are axially aligned with the portions of the blocks 13, 15 which communicate with the pump outlet zones within the housing 10, whereby pressures on the end faces 25, 26 oppose the axial forces applied, in use, to the blocks 13, 15 by a fluid pressure in the outlet port 12.

Figure 3:
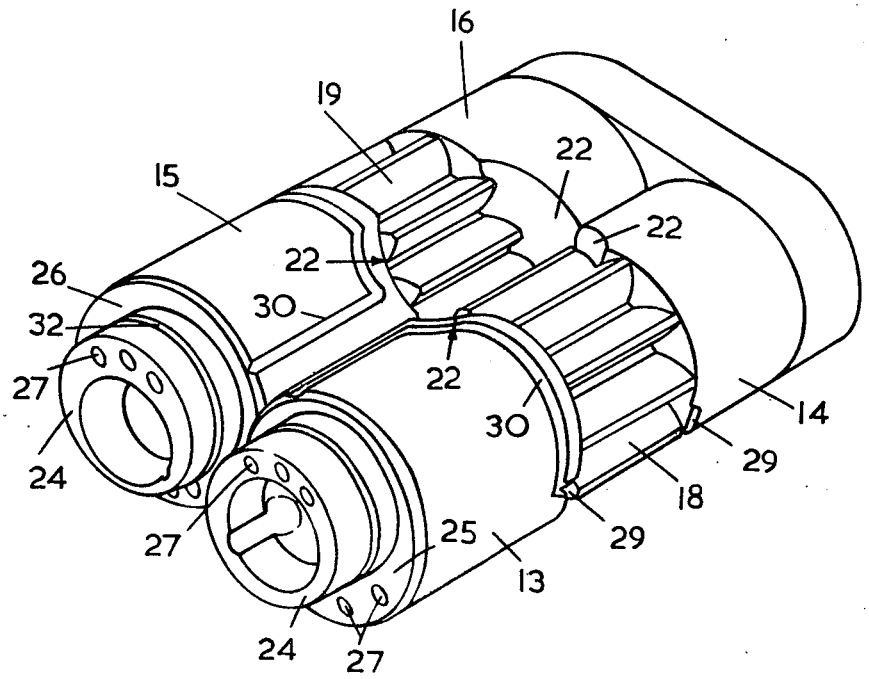
FIG. 3 shows in perspective parts of the pump as viewed in the direction of the arrow 3 in FIG. 1, and with the pump housing removed.

The faces 25, 26 and the end faces of spigots 24 are provided with recesses 27 for springs 34, shown displaced from the recesses 27 in FIG. 3. Springs 34 engage the housing 10 to urge the blocks 13, 15, gear elements 18, 19 and blocks 14, 16 to the right, as seen in FIGS. 1 and 3. Movement of the blocks 14, 16 to the right is restrained by an end plate 28 forming part of the housing 10. The springs thus serve to apply an initial axial compression between the gear elements 17, 18 and the bearing blocks.

The blocks 13, 14, 15, 16 are provided, adjacent the gear elements 18, 19 with gutters 29 which extend from the cut-away portions 23, for approximately 180° around the blocks against the directions of rotation of elements 18, 19. The ends of gutters 29 in blocks 13, 15 remote from portions 23 communicate with recesses 30 in the cylindrical surfaces of blocks 13, 15. The recesses 30 define, in conjunction with the housing 10, passages which extend around the circumferences of the blocks 13, 15 to locations adjacent the pump inlet port, and thence axially of the blocks 13, 15 to communicate with the end faces 25, 26.

A high pressure is thus, in use, applied to the end faces 25, 26. This pressure is retained by sealing rings 31 located in grooves 32 around the spigots 24, and opposes, as above described, axial forces due to pressure in the pump outlet.

The blocks 13, 14, 15, 16 have slight radial clearance in the housing 10, with this clearance being shown much exaggerated in FIG. 1, so that high pressure in the outlet 12 urges the blocks and the gear elements bodily in the general direction of the pump inlet port. The tips of the teeth of the gear elements 18, 19 stand slightly proud of the circumference of the blocks 13, 14, 15, 16. The teeth tips are therefore urged into interference with the housing 10 at locations thereon adjacent the pump inlet port. The gutters 29 in the blocks ensure that a high pressure fluid in the outlet port 12 enters between the gear teeth of the elements 18, 19 over approximately 180° of arc. The directions of the resultant lines of force on the gear elements 18, 19 are thus determined, and only three or four teeth on each element are wiping the housing 10 at any time.

The high pressures in the passages defined by the grooves 30 provide hydrostatic bearings which prevent the blocks 13, 15 from jamming within the housing 10 as a result of pressure in the outlet port 12. The blocks 13, 15 are thus axially slidable at all pressures in the outlet port 12.

Figure 2:
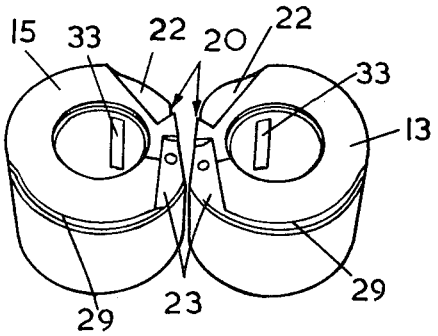
FIG. 2 shows in perspective two bearings of the pump.

Within the bores of the bearing blocks 13, 14, 15, 16 are shallow recesses, shown at 33 in FIG. 2. These recesses are located so as to be in advance of the position of maximum load applied to the blocks by the elements 18, 19. Recesses 33 communicate with the pump outlet port via resistors (not shown) and hydrodynamic wedge action of the journals.

I claim:

1. A gear pump or motor comprising a housing having a low pressure port and a high pressure port, two pairs of part cylindrical bearing blocks in the housing, said bearing blocks having axial end faces meshed gear elements having axial end faces said gear elements being journalled in the respective pairs of bearing blocks so that the axial end faces of the gear elements are engageable with adjacent end faces of the bearing blocks, one bearing block in each pair being axially movable in the housing, means for limiting the movement of the other bearing block in the pairs in response to pressure on the axial end faces of said movable bearing blocks remote from the gear elements, said blocks having recesses lying adjacent the respective zones at which the low pressure and high pressure ports open to the inside of the housing, and further recesses in the cylindrical surfaces of the movable bearing blocks which, in conjunction with the housing alone, define passages in communication with the high pressure recesses and extending around the cylindrical surfaces of the blocks to locations adjacent the low pressure port and thence axially of the movable bearing blocks to the remote axial end faces thereof.

2. The gear pump or motor as claimed in claim 1 in which said blocks have a radial clearance in said housing, and in which the tips of the teeth of said gear elements are proud of the cylindrical surfaces of said blocks.

3. The gear pump or motor as claimed in claim 1 in which said axial end faces of the blocks have centers of area which are offset from the axes of rotation of the respective gear elements.

4. The gear pump or motor as claimed in claim 1 which includes springs engageable between said housing and said movable blocks to urge the latter towards said gear elements.

* * * * *